US006170722B1

(12) United States Patent
Huang

(10) Patent No.: US 6,170,722 B1
(45) Date of Patent: Jan. 9, 2001

(54) THREADING APPARATUS

(76) Inventor: Dennis Huang, 5F, No. 10, Lane 9, Ningpo E. St., Taipei (TW)

( * ) Notice: Under 35 U.S.C. 154(b), the term of this patent shall be extended for 0 days.

(21) Appl. No.: 09/536,159

(22) Filed: Mar. 28, 2000

(51) Int. Cl.[7] ..... D05B 87/00
(52) U.S. Cl. ..... 223/99
(58) Field of Search ..... 223/99, 1; 112/224, 112/225

(56) References Cited

U.S. PATENT DOCUMENTS 694,984 * 3/1902 Olson ..... 223/99
2,777,623 * 1/1957 Balzer ..... 223/99
3,022,927 * 2/1962 Carlsen ..... 223/99
4,667,860 * 5/1987 Feuerman ..... 223/99
6,045,016 * 4/2000 Okada ..... 223/99

* cited by examiner

*Primary Examiner*—Bibhu Mohanty
(74) *Attorney, Agent, or Firm*—Bacon & Thomas, PLLC

(57) ABSTRACT

A threading apparatus for threading a thread through the eye of a sewing needle which includes a platform, a threading rack fixedly mounted on the platform, the threading rack having a compressible and resilient thread guide ring for holding the eye of a sewing needle for enabling a thread to be inserted through the sewing needle by inserting the thread through the thread guide ring above the eye of the sewing needle being coupled to the thread guide ring, and a spool holder fixedly mounted on the platform for holding a spool of thread.

11 Claims, 3 Drawing Sheets

THREADING APPARATUS

BACKGROUND OF THE INVENTION

The present invention relates to a threading apparatus, and more articularly to such a threading apparatus, which enables the user to hread a thread through the eye of a sewing needle with one hand.

In our daily life, we may have to sew a button on a coat, fasten or put fabric articles together with a sewing needle and thread. Because the open space of the eye of a regular sewing needle is tiny, it is not easy to pass a thread through the eye of a sewing needle. It is not a good experience to most people to thread a sewing needle with a thread. More particularly to a person having weaker sight, it is a thorny matter to pass a thread through the eye of a sewing needle. When threading the eye of a sewing needle with a thread, the sewing needle is held in one hand, and the thread is held in the other hand and aimed at the eye of the sewing needle. Small vibration of the hands may cause the thread unable to be passed through the eye of the sewing needle.

Further, when taking a thread from a spool of thread, a cutter or scissors may be used to cut the thread at the desired length. To aged people or people having weaker sight, a magnifier may be used to help threading the eye of a sewing needle with a thread. Some disabled people may be unable to thread the eye of a sewing needle with a thread by both hands. Due to the aforesaid reasons, most people would spend money to let their cloth repair works or other sewing works be done by a tailor. The difficulty in passing a thread through the eye of a sewing needle causes some sewing works unable to be done by one.

SUMMARY OF THE INVENTION

The present invention has been accomplished under the circumstances in view. It is one object of the present invention to provide a threading apparatus, which enables the user to thread a thread through the eye of a sewing needle easily. It is another object of the present invention to provide a threading apparatus, which enables the user to thread a thread through the eye of a sewing needle with one hand. It is still another object of the present invention to provide a threading apparatus, which is compact, and has storage means for keeping sewing accessories. According to the present invention, a threading apparatus comprises a threading rack, a spool holder, and a platform. The threading rack comprises a thread guide ring. The thread guide ring is preferably made of springy, compressible material, for example, resilient metal. The thread guide ring comprises two curved portions bilaterally disposed on the middle. The compressible thread guide ring can be inserted through the eye of a sewing needle. The spool holder is provided at the platform for holding a spool of thread, enabling the thread to be conveniently pulled out of the loaded spool of thread. The platform supports the threading rack and the spool holder, and is equipped with a drawer for keeping sewing accessories. A cover may be used and covered on the platform over the threading rack and the spool holder. When in use, the eye of the sewing needle is coupled to the thread guide ring and secured thereto at a bottom side, and then the thread is inserted through the thread guide ring above the eye of the sewing needle, and then the sewing needle is pulled away from the thread guide ring, enabling the thread to be suspended from the eye of the sewing needle. An auxiliary rack may be provided at the platform. The auxiliary rack comprises a cutter blade for cutting off threads, and thread retaining holes for holding individual pieces of threads. Further, a magnifier may be provided at the platform to help people having weaker sight in threading the thread.

DETAILED DESCRIPTION OF THE PREFERRED EMBODIMENT

Figure 1:
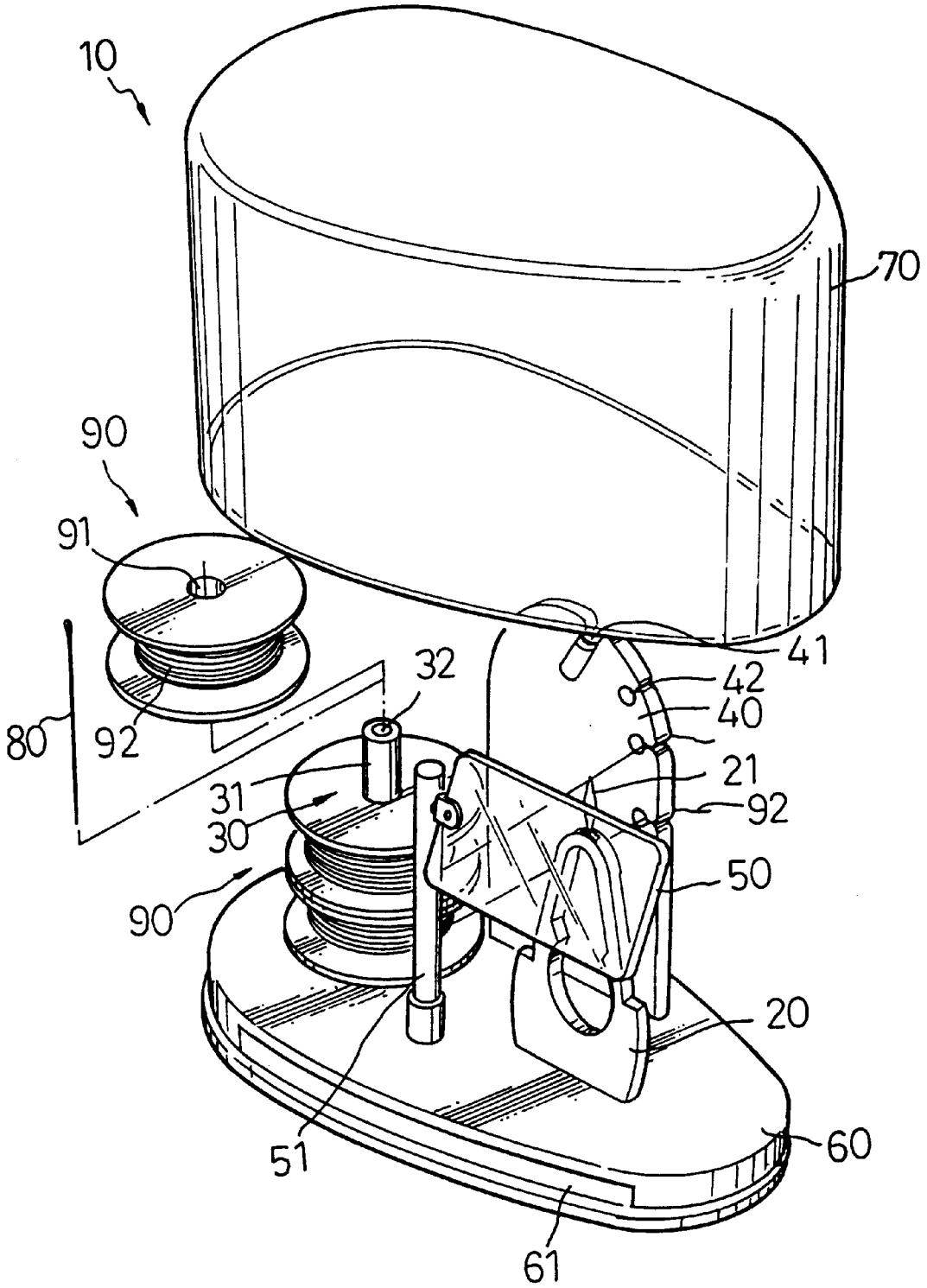
FIG. 1 is a perspective exploded view of a threading apparatus according to a first embodiment of the present invention.
Figure 2:
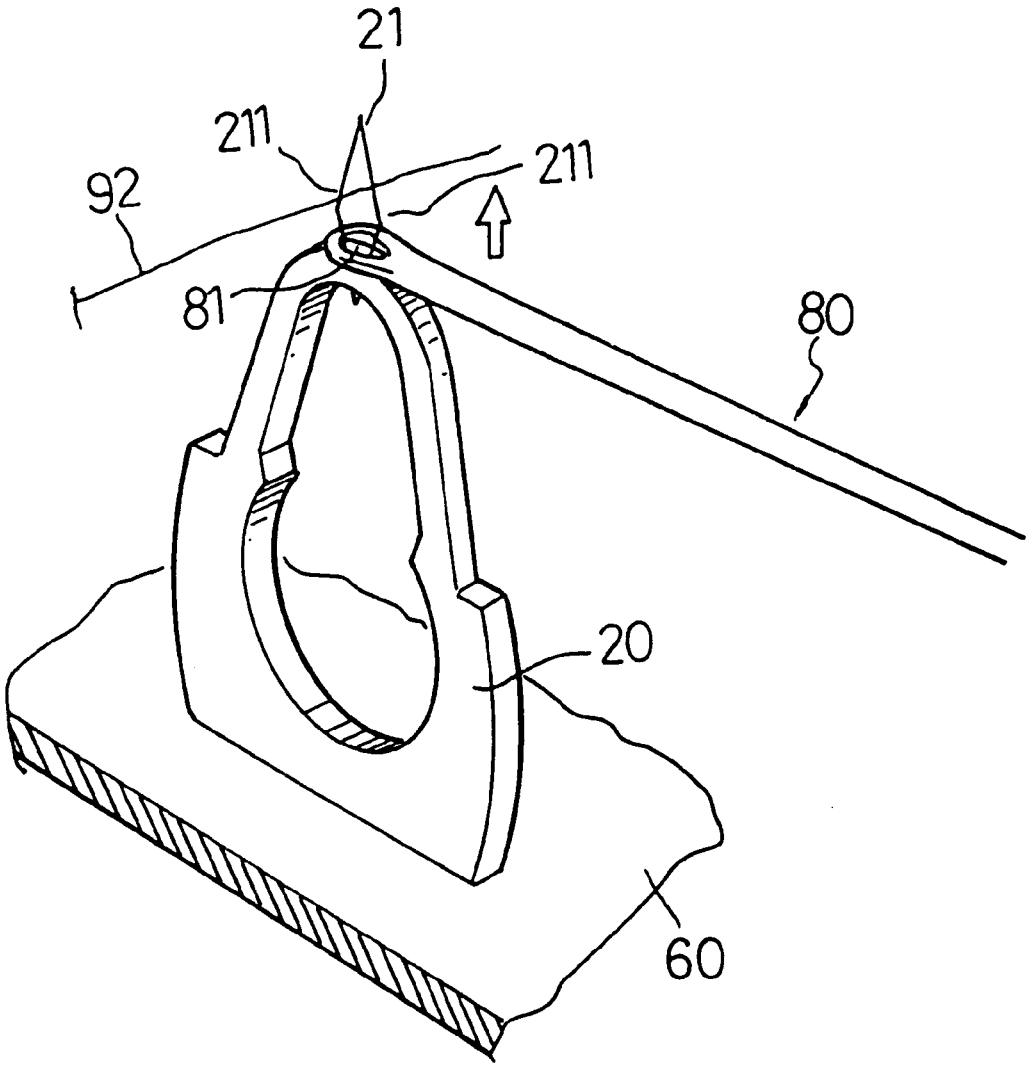
FIG. 2 is an enlarged view of a part of the present invention showing the eye of a sewing needle coupled to the thread guide ring, a thread passed through the thread guide ring.

Referring to FIGS. 1 and 2, a threading apparatus 10 is shown comprised of a threading rack 20, a spool holder 30, an auxiliary rack 40, a magnifier 50, a platform 60, and a cover 70.

The threading rack 20 is fixedly mounted on the platform 60, comprising a loop-like thread guide ring 21 made of a steel wire. The thread guide ring 21 has two curved portions 211 at two sides. The arrangement of the curved portions 211 provides the thread guide ring 21 with a rhombic shape. The thread guide ring 21 defines an open space through which the user to insert a thread 92. Because the thread guide ring 21 is made of a steel wire, it is compressible, and the user can couple the eye 81 of a sewing needle 80 to the thread guide ring 21 easily. After insertion of the thread guide ring 21 through the eye 81 of a sewing needle 80, the curved portions 211 immediately return to their former shape, thereby causing the eye 81 of the sewing needle 80 to be secured to the thread guide ring 21.

The spool holder 30 is mounted on the platform 60, comprising an upright shaft 31 for holding spools of thread 90 in a stack. The upright shaft 31 has an axially extended storage hole 32 for keeping sewing needles 80. When a spool of thread 90 is mounted on the spool holder 30, the. upright shaft 31 of the spool holder 30 is inserted through the axial center through hole 91 of the spool of thread 90. When pulling the thread 92 of a spool of thread 90 at the spool holder 30, the spool of thread 90 is turned about the upright shaft 31 to let off the thread 92.

The auxiliary rack 40 is fixedly mounted on the platform 60, comprising a cutter blade 41 for cutting the thread 92 of a spool of thread 90, and a plurality of thread retaining holes 42 for securing sewing threads.

The magnifier 50 is pivoted to an upright support 51 at the platform 60, and can be adjusted to the desired angle. The angle-adjustable coupling structure between the magnifier 50 and the upright support 51 can be achieved by conventional techniques. Alternatively, the magnifier 50 can be directly pivoted to the platform 60.

The platform 60 supports the threading rack 20, the spool holder 30, the auxiliary rack 40 and the magnifier 50, comprising a drawer 61 for keeping accessories and small articles, for example, spare sewing needles. The cover 70 fits the platform 60. When not in use, the cover 70 is covered on the platform 60.

The threading operation of the present invention comprises the steps of:

1. aiming the eye 81 of the sewing needle 80 at the thread guide ring 21, and then pressing down the sewing needle 80 to force the eye 81 over the curved portions 211 of the thread guide ring 21, enabling the eye 81 of the sewing needle 80 to be supported on the threading rack 20 and secured to the thread guide ring 21;
2. pulling out the thread 92 from one spool of thread 90 at the spool holder 30 or from one thread retaining hole

42, and then inserting the thread 92 through the open space defined within the thread guide ring 21 above the eye 81 of the sewing needle 80, and then releasing the hand from the thread 92 for enabling the thread 92 to be suspended from the thread guide ring 21;

3. lifting the sewing needle 80 from the thread guide ring 21 for enabling a part of the thread 92 to be arranged into a U-turn protruding over one side of the eye 81 of the sewing needle 80, and then pulling one end of the U-turn thread 92 out of the eye 81 of the sewing needle 80, enabling the two distal ends of the thread 92 to be disposed at two opposite sides of the eye 81 of the sewing needle 80, and then using the cutter blade 41 at the auxiliary rack 40 to cut off the thread 92 from the spool of thread 90, so as to complete the threading operation.

Figure 3:
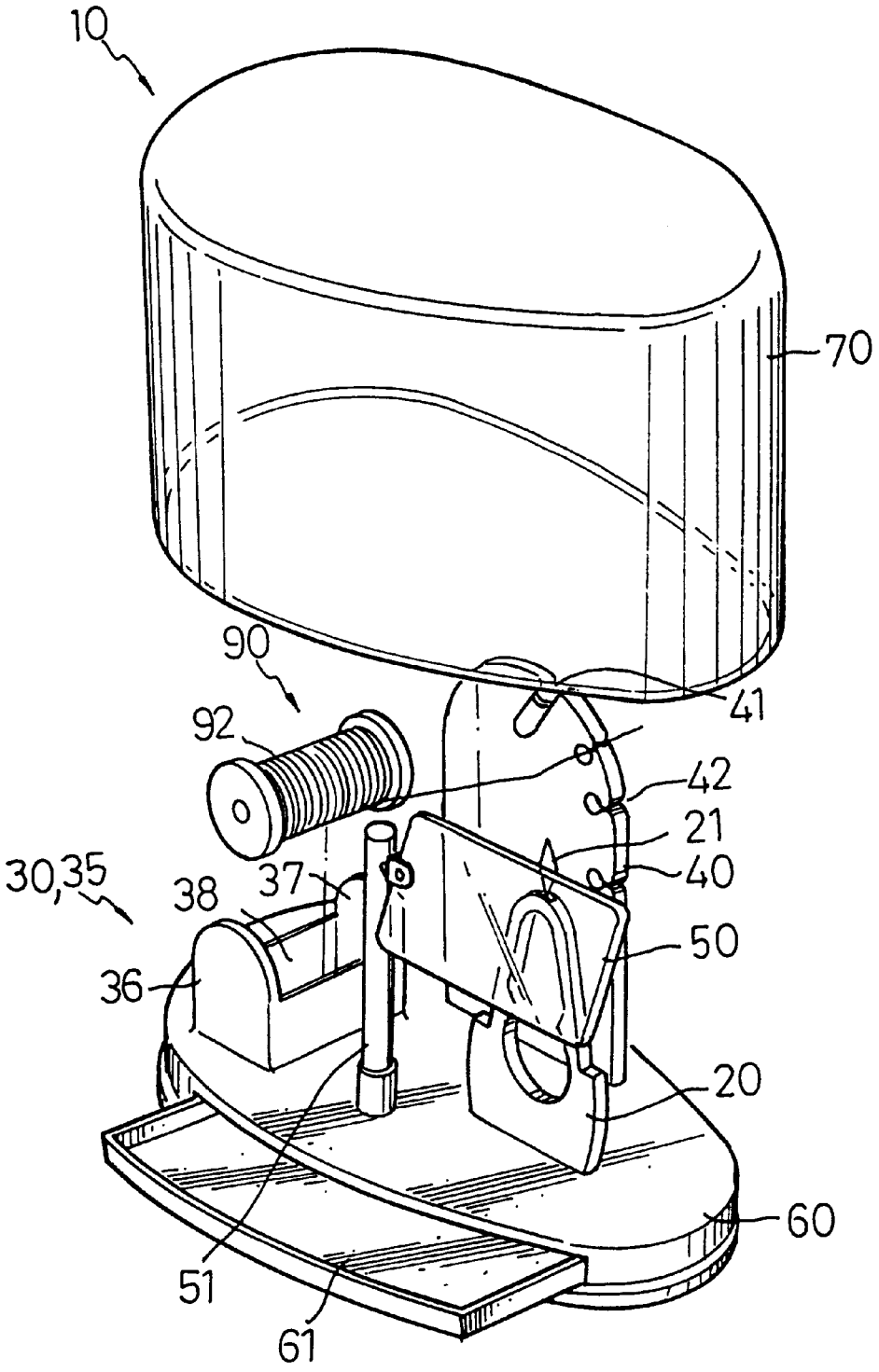
FIG. 3 is a perspective exploded view of a threading apparatus according to a second embodiment of the present invention.

FIG. 3 shows a threading apparatus according to a second embodiment of the present invention. According to this alternate form, the spool holder 30 comprises a box 35 having two upright sideboards 36 and 37 and a bearing portion 38 defined between the upright sideboards 36 and 37. The bearing portion 38 has a bottom wall transversely arched and curved inwards. The arched width of the bearing portion 38 is preferably shorter than one half of the circumference of the spool of thread 90 so that the spool of thread 90 can be inserted into the box 35.

It is to be understood that the drawings are designed for purposes of illustration only, and are not intended for use as a definition of the limits and scope of the invention disclosed.

What the invention claimed is:

1. A threading apparatus for threading a thread through the eye of sewing needle, comprising:

a platform;

a threading rack fixedly mounted on said platform, said threading back comprising a compressible thread guide ring for holding the eye of a sewing needle for enabling a thread to be inserted through the sewing needle by inserting the thread through the thread guide ring above the eye of the sewing needle being coupled to the thread guide ring;

a spool holder fixedly mounted on said platform for holding a spool of thread.

2. The threading apparatus of claim 1 wherein said thread guide ring is made of resilient material.

3. The threading apparatus of claim 2 wherein said thread guide ring is made of resilient metal.

4. The threading apparatus of claim 1 wherein said thread guide ring comprises at least one curved portion on the middle.

5. The threading apparatus of claim 1 wherein said spool holder comprises a spool box for holding a spool of thread.

6. The threading apparatus of claim 1 wherein said spool holder comprises an upright shaft for holding a spool of thread for enabling the loaded spool of thread to be rotated on said upright shaft.

7. The threading apparatus of claim 6 wherein said upright shaft comprises an axially extended storage hole.

8. The threading apparatus of claim 1 further comprising an auxiliary rack fixedly mounted on said platform, said auxiliary rack comprising a cutter blade and at least one thread-retaining hole.

9. The threading apparatus of claim 1 further comprising a magnifier pivoted to said platform.

10. The threading apparatus of claim 1 wherein said platform, comprises a drawer.

11. The threading apparatus of claim 1 further comprising a cover for covering said platform over said threading rack and said spool holder.

* * * * *